US006841939B2

(12) United States Patent
Scott et al.

(10) Patent No.: US 6,841,939 B2
(45) Date of Patent: Jan. 11, 2005

(54) FLUORESCENT LAMP

(75) Inventors: Curtis E. Scott, deceased, late of Mentor, OH (US); by Judith A. Scott, legal representative, Mentor, OH (US); Edward E. Hammer, Mentor, OH (US); Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 10/063,279

(22) Filed: Apr. 8, 2002

(65) Prior Publication Data

US 2003/0189409 A1 Oct. 9, 2003

(51) Int. Cl.[7] ..... H01J 17/20

(52) U.S. Cl. ..... 313/642; 313/486; 313/639; 313/565; 313/485; 313/487; 313/489

(58) Field of Search ..... 313/642, 486, 313/639, 565, 485, 487, 489

(56) References Cited

U.S. PATENT DOCUMENTS 3,602,758 A * 8/1971 Thornton et al. ..... 313/487
4,544,997 A * 10/1985 Seuter et al. ..... 313/483
5,008,789 A 4/1991 Arai et al.
5,045,752 A * 9/1991 Jansma ..... 313/487
5,051,653 A 9/1991 DeBoer et al.
5,170,095 A * 12/1992 Bardos et al. ..... 313/486
5,229,686 A * 7/1993 Fowler et al. ..... 313/565
5,602,444 A 2/1997 Jansma
5,614,783 A 3/1997 Fujino
5,619,096 A 4/1997 Kaliszewski et al.
5,726,528 A 3/1998 Jansma et al.
5,753,999 A 5/1998 Roozekrans et al.
5,754,002 A * 5/1998 Haitko et al. ..... 313/565
5,801,482 A 9/1998 Verhaar et al.
5,838,100 A 11/1998 Jansma
5,869,927 A 2/1999 Matsuo et al.
5,898,265 A * 4/1999 Woodward et al. ..... 313/486
5,907,216 A 5/1999 Ligthart et al.
6,174,213 B1 1/2001 Paz de Araujo et al.
6,222,318 B1 4/2001 Oomen et al.
6,400,097 B1 * 6/2002 Jin et al. ..... 315/246
6,538,378 B1 * 3/2003 Nakano ..... 313/571

* cited by examiner

*Primary Examiner*—Ashok Patel
*Assistant Examiner*—Holly Harper
(74) *Attorney, Agent, or Firm*—Pearne & Gordon LLP

(57) ABSTRACT

A mercury vapor discharge fluorescent lamp is provided that has a mercury barrier. The mercury barrier is effective to inhibit mercury atoms from absorbing into the glass envelope and amalgamating with sodium atoms in the envelope. The mercury barrier is substantially non-mercury absorptive, both when the lamp is on and when it is off.

30 Claims, 4 Drawing Sheets

FLUORESCENT LAMP

BACKGROUND OF INVENTION

1. Field of the Invention

The present invention relates to a fluorescent lamp. More particularly, it relates to a fluorescent lamp wherein penetration of mercury into the glass envelope is reduced or eliminated.

2. Description of Related Art

Mercury vapor discharge fluorescent lamps account for over 90 percent of commercial and office-space lighting. Fluorescent lamps typically include a glass envelope that is coated with a layer of phosphors to convert the ultraviolet radiation (UV) generated within the lamp into visible light.

Soda-lime glass is the most common type of glass for fluorescent lamps. Soda-lime glass is preferred because the sodium atoms (or ions) in the glass help prevent unconverted UV from escaping through the glass envelope.

However, a problem with soda-lime glass is that the sodium atoms in the glass attract mercury atoms from the mercury vapor within the lamp. This is because mercury and sodium form a stable amalgam which is retained in, thereby darkening, the glass envelope. This darkening can occur along the entire length of a fluorescent lamp, but often is most easily seen at the lamp ends, resulting in the end-discoloration or end-darkening commonly observed in fluorescent lamps.

As the glass envelope darkens, lumen maintenance of the fluorescent lamp is diminished because less visible light can escape. In addition, mercury atoms that have been absorbed into the glass envelope to become amalgamated with sodium are removed from the gaseous mercury phase within the lamp. The result is that the pressure of mercury vapor within the lamp is decreased over lamp life, and excess liquid mercury must be added to fluorescent lamps to make up the difference as mercury vapor absorbs into the glass envelope.

There is a need in the art for a fluorescent lamp that substantially reduces or prevents mercury vapor from absorbing into the glass envelope of the lamp. Preferably, such a lamp will have improved lumen maintenance and less discoloration of the glass envelope over existing fluorescent lamps.

SUMMARY OF INVENTION

A mercury vapor discharge fluorescent lamp is provided that has a light-transmissive glass envelope with an inner surface, a phosphor layer disposed adjacent the inner surface of the glass envelope, a discharge-sustaining fill gas of mercury vapor and inert gas sealed inside the envelope, and a mercury barrier. The mercury barrier is effective to inhibit mercury atoms from absorbing into the glass envelope and amalgamating with sodium atoms therein. The mercury barrier is substantially non-mercury absorptive.

DETAILED DESCRIPTION

As used herein, when a range such as 5 to 25 (or 5–25) is given, this means preferably at least 5, and separately and independently, preferably not more than 25. Also as used herein, degrees of discoloration refer to the degree of end-darkening or end-discoloration of a fluorescent lamp measured on a linear scale from 0 to 100. Zero degrees of discoloration indicates a completely transparent or clear glass envelope; i.e. a glass envelope with no end discoloration. One hundred degrees of discoloration indicate completely blackened or opaque envelope ends. It will be evident that a higher degree of discoloration indicates a greater degree of end-darkening or discoloration, and vice versa. Also as used herein, a "T8 fluorescent lamp" is a fluorescent lamp as commonly known in the art, preferably linear with a circular cross-section, preferably nominally 48 inches in length, and having a nominal outer diameter of 1 inch (eight times ⅛ inch, which is where the "8" in "T8" comes from). Less preferably, the T8 fluorescent lamp can be nominally 2, 3, 5 or 8 feet long, less preferably some other length. Alternatively, a T8 fluorescent lamp may be nonlinear, for example circular or otherwise curvilinear, in shape. Also as used herein and in the claims, when referring to sodium atoms in the glass envelope, the term sodium atoms includes both sodium atoms and sodium ions present in the glass envelope. Likewise, when referring to potassium atoms in the glass envelope (i.e. after ion exchange with sodium atoms therein as described below), the term potassium atoms includes both potassium atoms and potassium ions present in the glass envelope.

Figure 1:
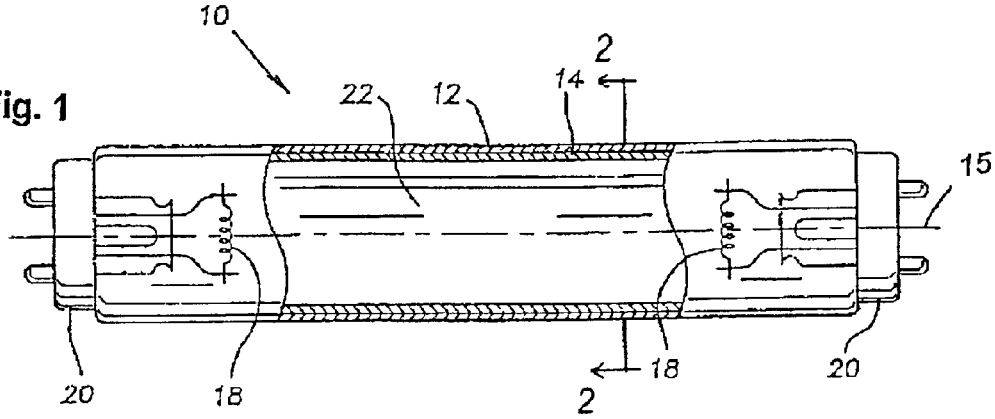
FIG. 1 is a side view, partially in section, of an invented fluorescent lamp according to a first preferred embodiment of the invention.

FIG. 1 shows a low pressure mercury vapor discharge fluorescent lamp 10 according to the invention. The fluorescent lamp 10 has a light-transmissive glass tube or envelope 12 which has a circular cross-section. The glass envelope 12 preferably has an inner diameter of 2.37 cm, and a length of 118 cm, though the glass envelope may have a different inner diameter or length. A phosphor layer 14 is disposed adjacent the inner surface 4 of the glass envelope 12, preferably on the inner surface 4. Phosphor layer 14 is preferably a rare earth phosphor layer, such as a rare earth triphosphor layer which is known or conventional in the art. Less preferably, phosphor layer 14 can be a halophosphate phosphor layer as known in the art.

The lamp is hermetically sealed by bases 20 attached at both ends, and a pair of spaced electrode structures 18 (which are means for providing a discharge) are respectively mounted on the bases 20. Alternatively, the lamp 10 can be an electrodeless fluorescent lamp as known in the art. A discharge-sustaining fill gas 22 of mercury vapor and an inert gas is sealed inside the glass envelope. The inert gas is preferably argon, krypton, neon, or a mixture thereof. The inert gas and a small quantity of mercury provide the low vapor pressure manner of operation. The fill gas 22 preferably has a total pressure of 1–5, preferably 2–4.5, preferably 2.5–4, torr at 25° C.

Figure 2:
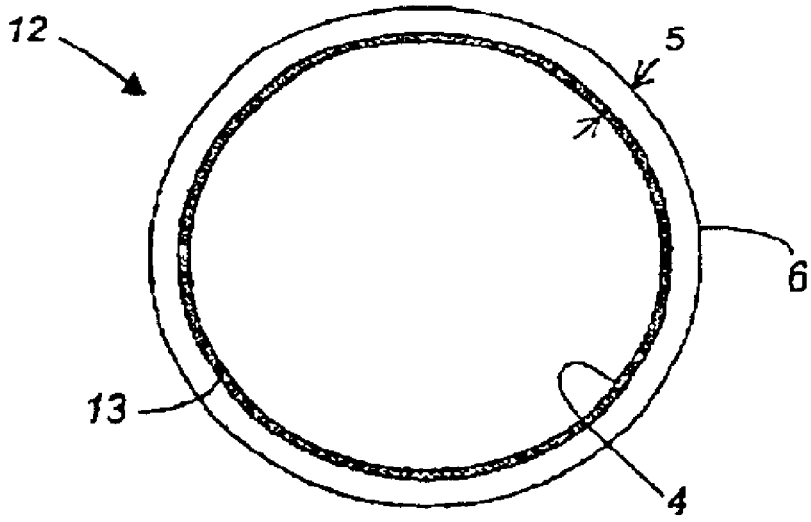
FIG. 2 is a cross-sectional view of the glass envelope of the lamp of FIG. 1 taken along line 2—2 in FIG. 1.

Referring to FIG. 2, the glass envelope 12 has an interior surface 4 and an exterior surface 6, with an overall thickness 5. Preferably, the thickness 5 of envelope 12 is uniform or substantially uniform about the circumference of the envelope 12. Preferably the glass envelope 12 is made from lime glass, preferably soda-lime glass (which has sodium atoms or ions in the glass), preferably GE 008 soda-lime glass having 17–20 weight percent sodium as is known in the art, less preferably another suitable glass material. Preferably, the glass envelope 12 is made from the above-described material in a conventional manner.

The invented lamp 10 has a mercury barrier to prevent or inhibit mercury atoms within lamp 10 from absorbing into the glass envelope 12 and amalgamating with sodium atoms therein. Preferably, the mercury barrier itself is non-mercury absorptive or substantially non-mercury absorptive, meaning that mercury from within the lamp 10 does not substantially absorb into the invented mercury barrier, either when the lamp is on or when the lamp is off. By substantially non-mercury absorptive, it is meant that mercury atoms from mercury vapor within the lamp 10 do not absorb within the invented mercury barrier to a significant extent; i.e. preferably the invented mercury barrier does not absorb mercury atoms, less preferably the mercury barrier absorbs less than 0.5, less preferably 1, less preferably 1.5, less preferably 2, less preferably 2.5, less preferably 3, weight percent mercury.

According to a first preferred embodiment of the invention, the mercury barrier is a mercury-insulating section 13 of the glass envelope 12. Preferably, the mercury-insulating section 13 is an annular section of the envelope 12 adjacent to inner surface 4 as shown in FIG. 2. Specifically, when viewed along its longitudinal axis 15, the envelope 12 has an overall thickness 5, with the mercury-insulating section 13 preferably being an annular portion of the envelope 12 that extends radially outward from, and includes, inner surface 4. Preferably, the mercury-insulating section 13 extends radially outward from the inner surface 4 of envelope 12 to a radial depth of at least 10, preferably at least 15, preferably at least 20, preferably at least 25, preferably 25–100, preferably 26–90, preferably 28–80, preferably 30–70, preferably 32–60, preferably 34–50, preferably 35–40, $\mu$m.

The mercury-insulating section 13 preferably is a compressional section of densely packed species, preferably metal ions or atoms, preferably potassium, less preferably calcium. Less preferably, the densely packed species are semi-metallic atoms or ions, less preferably any suitable ions or atoms, other species, or mixture thereof that is densely packed to provide a compressional mercury-insulating section 13 that is substantially transmissive of visible light, and does not substantially complex, react, or amalgamate with mercury vapor present in lamp 10. By compressional, it is meant that the species referred to above (e.g. potassium ions) is packed to sufficient density within the mercury-insulating section 13 to prevent (or substantially prevent or inhibit) mercury atoms from absorbing or migrating beyond the section 13 to amalgamate with sodium atoms in the envelope 12. Preferably, the species in section 13 is packed densely enough to prevent mercury absorption but not so densely as to result in section 13 being electrically conductive. Preferably, mercury-insulating section 13 is substantially electrically non-conductive. Substantially electrically non-conductive means that the mercury-insulating section 13 has a volume resistivity or impedance of at least $10^{12}$, preferably $10^{14}$, preferably $10^{16}$ Ω-cm at 25° C. As stated above, the mercury-insulating section 13 preferably is a compressional section of densely packed potassium atoms or ions, preferably having a depth of 25–100 $\mu$m measured radially outward from the inner surface 4 of envelope 12. When potassium is used in section 13, preferably section 13 is formed through ion exchange of sodium atoms by dipping the soda-lime glass envelope 12 in a potassium melt as follows. The envelope 12 is dipped into a molten potassium salt (e.g. molten potassium chloride, potassium nitrate, potassium borate, etc.), preferably at a temperature of 500–2000, preferably 600–1500, preferably 700–1100, degrees Celsius for 0.01–72, preferably 0.05–60, preferably 0.1–48, preferably 1–36, preferably 4–32, preferably 8–30, preferably 12–28, preferably 16–26, preferably 18–25, preferably about 24, hours. In this manner, sodium ions in the sodium-rich glass envelope 12 exchange with potassium ions from the potassium melt in a known manner, thereby depositing potassium ions into the glass envelope 12 through inner surface 4, and depleting sodium atoms therefrom. The potassium ions provide a compressional mercury-insulating section 13 in the glass envelope 12.

The potassium ions deposited into the glass envelope 12 are larger than the sodium atoms which they replace, resulting in denser ion packing, and are effective to reduce, preferably prevent or substantially prevent or inhibit, migration of mercury atoms therethrough. The potassium ions also will not strongly amalgamate or react with mercury atoms present within a fluorescent lamp 10. Thus, the deposited potassium atoms result in the formation of the mercury-insulating section 13 of the glass envelope 12 adjacent the inner surface 4. The depth of the section 13 is determined by the depth beyond the inner surface 4 to which potassium atoms are exchanged with sodium atoms in the glass envelope 12 during dipping as described above. This depth can be controlled, for example, by the length of time the envelope 12 is dipped into the potassium melt as well as its temperature. For a preferred section 13 having a depth of 35–40 $\mu$m, the dipping time is preferably about 24 hours at 700–1100° C.

A glass envelope 12 having a mercury-insulating section 13 of potassium atoms as above described has several advantages over conventional fluorescent lamps having non-ion exchanged soda-lime glass envelopes. The invented lamp 10 preferably has improved shatter strength over conventional fluorescent lamps. The improved strength is believed due to the elevated density of the mercury-insulating section 13. In addition, the invented lamp 10 has improved lumen maintenance and significantly reduced end-discoloration because formation of the dark sodium-mercury amalgam is substantially eliminated. Lumen maintenance at a given time, t, is the ratio of lumens at time t to lumens at 100-hours of operation. Preferably, an invented lamp 10 exhibits a lumen maintenance of at least 0.88, preferably 0.9, preferably 0.92, preferably 0.94, preferably 0.96, preferably 0.98 at 2000 hours of operation, preferably at 2000 hours of cyclical operation, preferably at 3000 hours of operation, preferably at 3000 hours of cyclical operation. (Cyclical operation means that the lamp is periodically or cyclically turned off and then back on).

In another embodiment, the invented mercury barrier (mercury-insulating section 13) can be used in a high wattage fluorescent lamp as known in the art. High wattage fluorescent lamps are brighter (deliver higher lumens) compared to standard fluorescent lamps, and have correspondingly higher electrical discharge loading. A high wattage lamp utilizing a mercury barrier according to the invention (such as mercury-insulating section 13), preferably has a lumen maintenance of at least 0.6, more preferably 0.7, at 2000 hours of continuous or cyclical operation, more preferably at 3000 hours of continuous or cyclical operation.

An invented lamp 10 can be provided with less liquid mercury than conventional lamps because little or no liquid mercury is required to replace mercury leaving the vapor phase for the glass envelope 12. For example, a T8 lamp according to the invention preferably contains about 5 mg of mercury less preferably 4.5–5.5, less preferably 4–6, less preferably 4–7, less preferably 4–8, mg of mercury. Whereas a conventional T8 lamp typically contains greater than 8 mg of mercury.

An invented lamp 10 having a mercury-insulating section 13 of potassium atoms also significantly or substantially eliminates the need for a barrier coating layer (such as an alumina barrier layer as known in the art). Although an alumina barrier layer also reduces mercury absorption into the glass envelope 12, it is known that mercury is absorbed by the alumina in the barrier layer itself when the lamp is off. The absence of an alumina barrier layer results in faster warm-up times because it is not necessary to expel mercury from the alumina layer at lamp startup.

Figure 3:
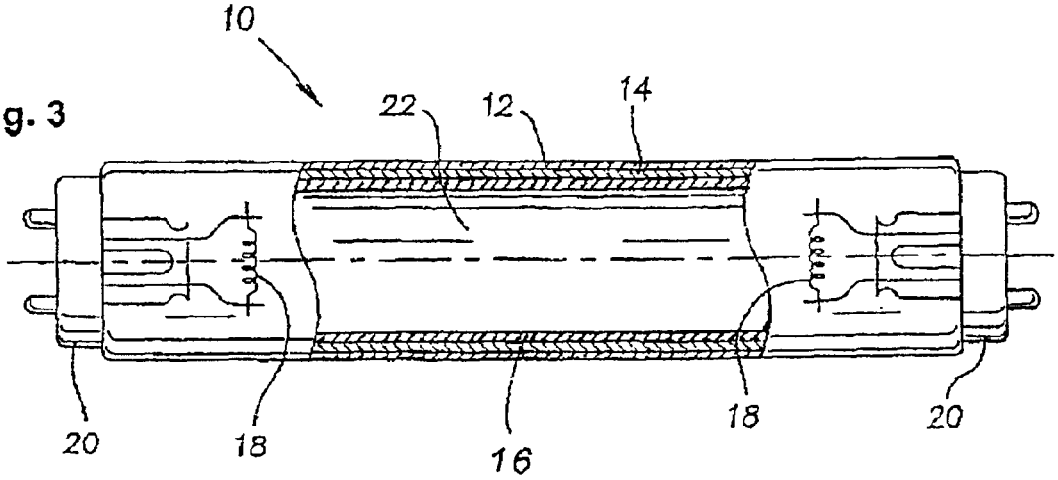
FIG. 3 is a side view, partially in section, of an invented fluorescent lamp according to a second preferred embodiment of the invention.
Figure 4:
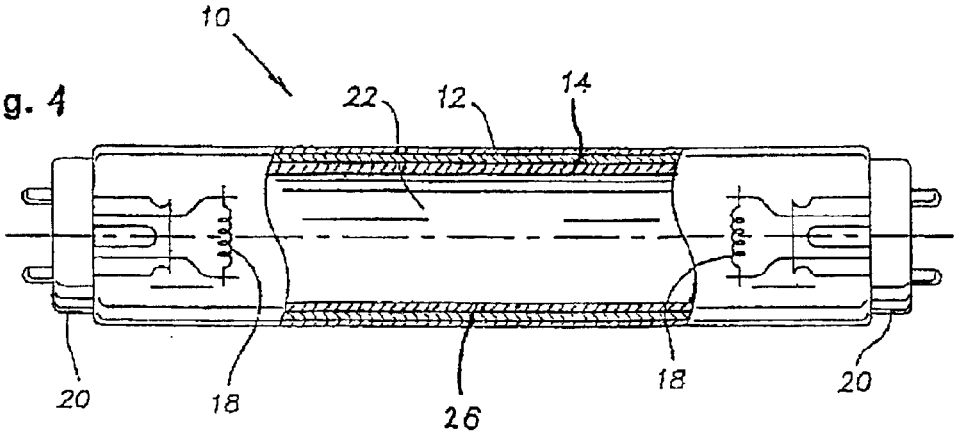
FIG. 4 is a side view, partially in section, of an invented fluorescent lamp according to a third preferred embodiment of the invention.

FIG. 3 shows a second preferred embodiment of the invention, where the mercury barrier is a separate mercury barrier layer 16 applied over phosphor layer 14. Less preferably, the mercury barrier layer 16 can be disposed between the phosphor layer 14 and the glass envelope 12. In this embodiment, a thin coating of a mercury-insulating species, preferably a potassium salt, is applied over phosphor layer 14 as shown in FIG. 3. Preferably, the potassium salt can be applied as an aerosol or as an electrostatic coating over phosphor layer 14. Preferably, mercury barrier layer 16 is a potassium-containing layer, preferably at least 0.5, preferably 0.8, preferably 1, weight percent potassium, and is preferably about 10–100, preferably 20–90, preferably 30–80, preferably 35–70, preferably 40–60, preferably 45–55, preferably about 50, nm thick. FIG. 4 shows a third preferred embodiment of the invention, where the mercury barrier is a tin oxide barrier layer 26 coated or disposed on the inner surface 4 of the glass envelope 12. Less preferably, the tin oxide barrier layer 26 can be disposed over the phosphor layer 14 opposite the glass envelope 12. In this embodiment, the tin oxide layer 26 is a compressional layer of densely packed non-activated and substantially electrically non-conductive tin oxide. Preferably, the tin oxide layer 26 is 5–200, preferably 7.5–150, preferably 10–100, preferably 20–90, preferably 25–80, preferably 30–70, preferably 40–60, preferably 45–55, preferably about 50, nanometers thick. The tin oxide layer 26 is preferably coated onto the inner surface 4 of envelope 12 via a conventional pyrolytic spray method.

In another preferred embodiment the mercury barrier is provided directly in the phosphor layer 14. In this embodiment, a metal ion species, preferably a potassium or calcium species, preferably a potassium species, preferably a potassium salt such as potassium chloride, potassium nitrate, potassium borate, or a mixture thereof, is added to the phosphor coating slurry prior to coating the phosphor layer 14 onto or adjacent inner surface 4 of the glass envelope 12. Phosphor coating slurries, including methods of preparing and applying them, are known or conventional in the art. When a potassium salt is added to the phosphor coating slurry, preferably the potassium salt is 0.01–10, preferably 0.05–5, preferably 0.08–2, preferably 0.1–1, weight percent of the phosphor coating slurry on a dry basis. Less preferably, crushed or ground or particulate potassium-rich glass is added to the phosphor coating slurry prior to coating on or adjacent the inner surface 4 of glass envelope 12, preferably in a similar amount as described above for potassium salt. Once coated adjacent inner surface 4, the resulting phosphor layer 14 is a potassium-enhanced phosphor/barrier layer matrix that is effective to reduce or substantially prevent mercury migration from the interior volume of lamp 10 to the glass envelope 12.

The same methodology as described above can also be applied to provide a potassium-enhanced alumina barrier, e.g. in a Starcoat™ fluorescent lamp from General Electric Company as known in the art. In this case, the potassium salt is added to the alumina barrier layer coating slurry similarly as above described with respect to the phosphor coating slurry.

An invented lamp having a mercury barrier according to the invention preferably exhibits fewer than 30, preferably 25, preferably 20, preferably 15, preferably 12, preferably 10, preferably 9, preferably 8, preferably 7, preferably 6, preferably 5, preferably 4, degrees of discoloration at 2000 hours of operation, preferably at 2000 hours of cyclical operation as described below, more preferably at 3000 hours of operation or cyclical operation. An invented lamp having a mercury barrier according to the invention also exhibits greater lumen efficiency. Preferably, an invented lamp has a lumen efficiency of at least 54, preferably 56, preferably 58, preferably 60, preferably 62, preferably 64, lumens/watt at 2000 hours of operation, preferably at 2000 hours of cyclical operation.

The invention will be better understood in conjunction with the following examples provided by way of illustration and not limitation.

EXAMPLE 1

An experiment was performed to compare the performance of invented fluorescent lamps to traditional fluorescent lamps.

Three sets of T8 fluorescent lamps were prepared, each set consisting of two fluorescent lamps. The first lamp in each set had a standard glass envelope with no mercury-insulating section, and the second lamp in each set had a glass envelope with a mercury-insulating section 13 of potassium according to the invention. The glass envelopes in the invented lamps were prepared by dipping as described above. The three sets of T8 lamps were as follows: a) T8 fluorescent lamps having no phosphors but only a glass envelope 12 (Blank lamps); b) standard T8 fluorescent lamps having a conventional triphosphor layer disposed adjacent the inner surface 4 of the glass envelope 12 (Standard lamps); and c) Starcoat™ T8 fluorescent lamps from General Electric Company as known in the art having both a triphosphor layer and an alumina barrier layer disposed adjacent the inner surface 4 of the glass envelope 12 (Starcoat lamps). Except for the presence or absence of an invented mercury-insulating section 13, the lamps in each set were substantially identical in other respects.

For the invented lamp in each of the three sets, the mercury-insulating section 13 of the glass envelope 12 was a compressional section of densely packed potassium ions, with a depth of about 50 nm from the inner surface 4. All six lamps (both lamps in each of the three above sets) were initially filled with 5 mg of mercury, and operated cyclically for 3000 hours in a side-by-side comparison experiment. In this case the cycle times were 3 hours on and 20 minutes off. It will be understood that this 3 hour/20 minute on/off cycle was to simulate actual on/off conditions undergone by fluorescent lamps in the marketplace. However, other cycles with varied on/off times, such as those as may be experienced in a typical commercial or office installation, though not identical to the cycle times described here, would be expected to yield the same or similar results as obtained and reported below at 2000 and 3000 hours respectively.

Performance data comparing all six lamps at 2000 hours is provided below in table 1. In table 1, the notation "No K" indicates a traditional fluorescent lamp having a glass envelope without a mercury-insulating section, and "With K"

indicates an invented fluorescent lamp that has a glass envelope with a mercury-insulating section 13 of potassium as described.

TABLE 1

| | 2000-hour comparison data for invented versus traditional fluorescent lamps | | | | | | | |
|---|---|---|---|---|---|---|---|---|
| | Lumens | | Lumens/Watt | | Degrees of Discoloration | | Lumen Maintenance | |
| Lamp Set | No K | With K | No K | With K | No K | With K | No K | With K |
| Blank | 84 | 97 | 4.8 | 5.5 | 15 | 8.7 | 0.87 | 0.942 |
| Standard T8 | 936 | 1094 | 52.6 | 60.8 | 27.4 | 1.6 | 0.869 | 0.966 |
| Starcoat T8 | 1187 | 1197 | 66.5 | 67 | 45.6 | 3.6 | 0.975 | 0.975 |

As seen in table 1, the invented lamps performed better than traditional lamps in all three lamp sets. Most notably, the invented Standard T8 lamp (i.e. with no alumina barrier layer) exhibited only 1.6 degrees of discoloration at 2000 hours of operation, compared to 27.4 degrees for the corresponding traditional lamp. This represents a 94% reduction in degrees of discoloration at 2000 hours of operation, which was an extremely surprising and unexpected result. Furthermore, the invented standard lamp produced 60.8 lumens/watt at 2000 hours, compared with 52.6 lumens/watt for the corresponding traditional lamp; about a 15% improvement. This was also an extremely surprising and unexpected result.

Also noteworthy is that lumen maintenance of the invented lamps was significantly greater than the corresponding traditional lamps for both the Blank and Standard lamp sets; (e.g. the invented Standard lamp exhibited a lumen maintenance of 0.966, compared to 0.869 for the traditional Standard lamp, an 11% improvement).

EXAMPLE 2

Table 2 below provides the performance data for the six lamps described above in Example 1, but at 3000 hours. The notations "No K" and "With K" are the same as described above.

TABLE 2

| | 3000-hour comparison data for invented versus traditional fluorescent lamps | | | | | | | |
|---|---|---|---|---|---|---|---|---|
| | Lumens | | Lumens/Watt | | Degrees of Discoloration | | Lumen Maintenance | |
| Lamp Set | No K | With K | No K | With K | No K | With K | No K | With K |
| Blank | 81 | 95 | 4.6 | 54 | 20 | 9 | 0.84 | 0.923 |
| Standard T8 | 897 | 1074 | 50.7 | 59.7 | 30 | 2 | 0.832 | 0.948 |
| Starcoat T8 | 1167 | 1182 | 65.8 | 65.6 | 52.6 | 4.2 | 0.97 | 0.97 |

As seen in table 2, the invented lamps performed better than traditional lamps out to 3000 hours. Most notably, the invented Standard T8 lamp (i.e. with no alumina barrier layer) exhibited only 2 degrees of discoloration at 3000 hours of operation, compared to 30 degrees for the corresponding traditional lamp. It was very surprising and unexpected that the invented Standard T8 lamp only exhibited an increase of 0.4 degrees of discoloration (from 1.6 to 2) between 2000 and 3000 hours of cyclical operation. Compared to the traditional Standard T8 lamp at 3000 hours, the invented Standard T8 exhibited a 93% reduction in degrees of discoloration, also an extremely surprising and unexpected result.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge fluorescent lamp comprising a light-transmissive glass envelope having an inner surface, a phosphor layer disposed adjacent said inner surface of said glass envelope, and a discharge-sustaining fill gas of mercury vapor and inert gas sealed inside said envelope, said glass envelope comprising an integral annular mercury-insulating portion of said glass envelope, said annular mercury-insulating portion being effective to inhibit mercury atoms from absorbing into said glass envelope and amalgamating with sodium atoms therein.

2. A lamp according to claim 1, said glass envelope being made from soda-lime glass.

3. A lamp according to claim 1, said mercury-insulating portion of said glass envelope comprising a material selected from the group consisting of non-sodium metal ions, non-sodium metal atoms, semi-metallic ions, semi-metallic atoms, and mixtures thereof.

4. A lamp according to claim 1, said mercury-insulating portion of said glass envelope comprising a material selected from the group consisting of potassium atoms, potassium ions, calcium atoms and calcium ions.

5. A lamp according to claim 1, said mercury-insulating portion having a radial depth of at least 10 $\mu$m measured from said inner surface of said glass envelope.

6. A lamp according to claim 5, said radial depth of said mercury-insulating portion being 25–100 $\mu$m.

7. A lamp according to claim 1, wherein said mercury-insulating portion is a compressional portion comprising densely packed species, and wherein said densely packed species does not substantially complex, react, or amalgamate with said mercury vapor inside said envelope.

8. A lamp according to claim 1, wherein said mercury-insulating portion is substantially transmissive of visible light.

9. A lamp according to claim 7, wherein said densely packed species is selected from the group consisting of potassium atoms and potassium ions.

10. A lamp according to claim 7, wherein said densely packed species is selected from the group consisting of calcium atoms and calcium ions.

11. A lamp according to claim 1, wherein said mercury-insulating portion of said glass envelope is substantially electrically non-conductive.

12. A lamp according to claim 1, said lamp exhibiting fewer than 30 degrees of discoloration at 2000 hours of cyclical operation.

13. A lamp according to claim 1, said lamp exhibiting fewer than 30 degrees of discoloration at 3000 hours of cyclical operation.

14. A lamp according to claim 1, said lamp having a lumen efficiency of at least 54 lumens/watt at 2000 hours cyclical operation.

15. A lamp according to claim 1, said lamp having a lumen efficiency of at least 54 lumens/watt at 3000 hours of cyclical operation.

16. A lamp according to claim 1, said lamp having a lumen maintenance of at least 0.88 at 2000 hours of cyclical operation.

17. A lamp according to claim 1, said lamp having a lumen maintenance of at least 0.88 at 3000 hours of cyclical operation.

18. A lamp according to claim 1, said lamp being a high wattage fluorescent lamp and having a lumen maintenance of at least 0.6 at 2000 hours of cyclical operation.

19. A lamp according to claim 1, said lamp being a high wattage fluorescent lamp and having a lumen maintenance of at least 0.6 at 3000 hours of cyclical operation.

20. A lamp according to claim 1, said annular mercury-insulating portion of said glass envelope comprising potassium species and being formed through ion exchange with sodium atoms initially present in the glass envelope by dipping the envelope in a potassium melt.

21. A lamp according to claim 1, said annular mercury-insulating portion of said glass envelope extending from said inner surface thereof to a radial depth measured radially outward from said inner surface.

22. A mercury vapor discharge fluorescent lamp comprising a light-transmissive glass envelope having an inner surface, a phosphor layer disposed adjacent said inner surface of said glass envelope, a separate mercury barrier layer disposed adjacent said phosphor layer, and a discharge-sustaining fill gas of mercury vapor and inert gas sealed inside said envelope, said mercury barrier layer comprising a material selected from the group consisting of potassium salts, calcium salts and mixtures thereof, said mercury barrier layer being effective to inhibit mercury atoms from absorbing into said glass envelope and amalgamating with sodium atoms therein.

23. A lamp according to claim 22, said mercury barrier layer comprising at least 0.5 weight percent potassium.

24. A lamp according to claim 23, said mercury barrier layer being 10–100 nm thick.

25. A mercury vapor discharge fluorescent lamp comprising a light-transmissive glass envelope having an inner surface, a mercury barrier layer disposed adjacent said inner surface of said glass envelope, a phosphor layer disposed adjacent said mercury barrier layer, and a discharge-sustaining fill gas of mercury vapor and inert gas sealed inside said envelope, said mercury barrier layer being a compressional layer of densely packed non-activated and substantially electrically non-conductive tin oxide.

26. A lamp according to claim 25, said tin oxide barrier layer being 5–200 nanometers thick.

27. A mercury vapor discharge fluorescent lamp comprising a light-transmissive glass envelope having an inner surface, a phosphor layer disposed adjacent said inner surface of said glass envelope, and a discharge-sustaining fill gas of mercury vapor and inert gas sealed inside said envelope, said phosphor layer comprising at least one potassium species to provide a mercury barrier therein, said mercury barrier of said phosphor layer being effective to inhibit mercury atoms from absorbing into said glass envelope and amalgamating with sodium atoms therein.

28. A lamp according to claim 27, wherein said potassium species is a potassium salt selected from the group consisting of potassium chloride, potassium nitrate, potassium borate, and mixtures thereof.

29. A lamp according to claim 22, said mercury barrier layer being a potassium salt barrier layer.

30. A lamp according to claim 27, said potassium species being a potassium salt.

* * * * *

UNITED STATES PATENT AND TRADEMARK OFFICE

CERTIFICATE OF CORRECTION

PATENT NO. : 6,841,939 B2
DATED : January 11, 2005
INVENTOR(S) : Scott et al.

It is certified that error appears in the above-identified patent and that said Letters Patent is hereby corrected as shown below:

Title page,
Item [75], Inventor, after "Edward E. Hammer" delete "Mentor" and insert therefor -- Mayfield Village --.

Signed and Sealed this

Twelfth Day of July, 2005

JON W. DUDAS
*Director of the United States Patent and Trademark Office*